US008151683B2

(12) United States Patent
Dick et al.

(10) Patent No.: US 8,151,683 B2
(45) Date of Patent: Apr. 10, 2012

(54) LINK CHUTE EJECTION ADAPTER

(75) Inventors: Glen Dick, Jasper, IN (US); James Buechler, Jasper, IN (US); Michael Holzmeyer, Bloomfield, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 365 days.

(21) Appl. No.: 12/568,462

(22) Filed: Sep. 28, 2009

(65) Prior Publication Data

US 2010/0319521 A1 Dec. 23, 2010

Related U.S. Application Data

(60) Provisional application No. 61/219,599, filed on Jun. 23, 2009.

(51) Int. Cl.
*F41A 9/34* (2006.01)

(52) U.S. Cl. ..... 89/33.14

(58) Field of Classification Search ..... 89/33.14, 89/33.16, 33.2, 33.25
See application file for complete search history.

(56) References Cited

U.S. PATENT DOCUMENTS

| | | | | |
|---|---|---|---|---|
| 2,384,678 | A | 9/1945 | Holton | |
| 2,603,130 | A | 7/1952 | Bonkemeyer | |
| 2,889,751 | A * | 6/1959 | Bilek | 89/34 |
| 3,229,584 | A * | 1/1966 | Zehuder | 89/33.25 |
| 3,855,686 | A | 12/1974 | Snyder | |
| 3,955,469 | A * | 5/1976 | Conley | 89/33.14 |
| 6,286,411 | B1 | 9/2001 | Sanderson | |
| 6,443,044 | B1 * | 9/2002 | Dillon | 89/12 |
| 7,258,055 | B1 | 8/2007 | Javorsky | |
| 7,543,524 | B1 | 6/2009 | Javorsky | |

OTHER PUBLICATIONS

Photos—FN Herstal link chute adapter-5 pages (prior to Jun. 10, 2009).
Photos—Navy Part No. 3392A5371 link chute adapter-4 pages (prior to Jun. 10, 2009).

* cited by examiner

*Primary Examiner* — Stephen M Johnson
(74) *Attorney, Agent, or Firm* — Christopher A. Monsey

(57) ABSTRACT

A link chute ejection adapter for conveying spent links of an ammunition belt from the receiver chamber of a machine gun to a link chute.

17 Claims, 15 Drawing Sheets

LINK CHUTE EJECTION ADAPTER

CROSS-REFERENCE TO RELATED APPLICATION

The present application claims priority to U.S. Provisional Patent Application Ser. No. 61/219,599, filed Jun. 23, 2009, the disclosure of which is expressly incorporated by reference herein.

STATEMENT REGARDING FEDERALLY SPONSORED RESEARCH OR DEVELOPMENT

The invention described herein includes contributions by one or more employees of the Department of the Navy made in performance of official duties and may be manufactured, used and licensed by or for the United States Government for any governmental purpose without payment of any royalties thereon.

BACKGROUND AND SUMMARY OF THE DISCLOSURE

The present disclosure relates generally to weapons systems and, more particularly, to a link chute ejection adapter for conveying spent links of an ammunition belt from the receiver chamber of a machine gun to a link chute.

Conventional automatic weapons, such as machine guns, are often configured to utilize ammunition belts including a plurality of rounds successively coupled together through the use of links. More particularly, the rounds typically include a casing for a bullet, wherein successive casings are coupled together utilizing metal links. The ammunition belt is illustratively fed through the receiver chamber of the machine gun utilizing a feed slider assembly. Once the bullet has been discharged from the casing during operation of the gun, the casing is typically ejected downwardly from the receiver chamber. The spent links are typically ejected laterally outwardly from the receiver chamber and into a link chute. While link chute ejection adapters have been utilized in the past to facilitate conveyance of spent links to the link chute, jamming of the links within prior art link chute ejection adapters has been a recurring problem.

According to an illustrative embodiment of the present disclosure, a link chute ejection adapter for a weapon discharging rounds from an ammunition belt includes a base, and a cover positioned above the base. A first side wall is coupled to the base and the cover, and includes a proximal end configured to be removably received within a receiver chamber of the weapon. A second side wall is positioned in spaced relation to the first side wall and is coupled to the base and the cover. The base includes a tongue supported at the proximal end for mating with the floor of the receiver chamber of the weapon, and a mounting boss extending downwardly from the tongue. A link chute coupler is supported at the distal end of the base. An ejection chamber is defined by the base, the cover, the first side wall, and the second side wall. The ejection chamber extends in an axial direction generally along a longitudinal axis from a proximal end to a distal end, the proximal end being coupled to the receiver chamber of the weapon and the distal end being coupled to an ejection chute. A casing stop is supported by the proximal end of the first side wall for locating a casing of the ammunition belt. A bullet stop is supported by the proximal end of the second side wall for locating a bullet of the ammunition belt. The bullet stop includes a finger extending axially outwardly away from the ejection chamber and transversely outwardly away from an outer surface of the second side wall.

According to another illustrative embodiment of the present disclosure, a method of ejecting spent links from a weapon system includes the steps of aligning a link ejection chute adapter to a receiver of a weapon such that a tongue at the proximal end of the link chute ejection adapter is substantially flush with a receiving floor of the receiver, and coupling the link chute ejection adapter to the receiver. The method further includes the steps of coupling a link chute to a distal end of the link ejection chute adapter, and drawing an ammunition belt into a receiver chamber of the weapon, the ammunition belt including rounds of ammunition connected by links, each of the rounds including a bullet and a casing. The method also includes the steps of locating a casing of the ammunition when the round is drawn into the receiver chamber of the weapon by a casing stop member supported at a proximal end of a first side wall of the link ejection chute adapter, and locating a bullet of the ammunition when the round is drawn into the receiver chamber of the weapon by a bullet stop member supported at the proximal end of a second side wall of the link ejection chute adapter. The method further includes the steps of expelling the bullet from the casing, wherein the bullet is expelled from the casing by activation of a firing mechanism of the weapon, ejecting the casing from the receiver chamber, wherein the casing is ejected downwardly from the weapon following the expelling of the bullet from the casing, ejecting the link from the receiver chamber, wherein the link is ejected laterally from the receiver chamber, and guiding the link into the link ejection chute adapter.

BRIEF DESCRIPTION OF THE DRAWINGS

The foregoing aspects and many of the attendant advantages of this invention will become more readily appreciated as the same become better understood by reference to the following detailed description when taken in conjunction with the accompanying drawings.

Figure 1:
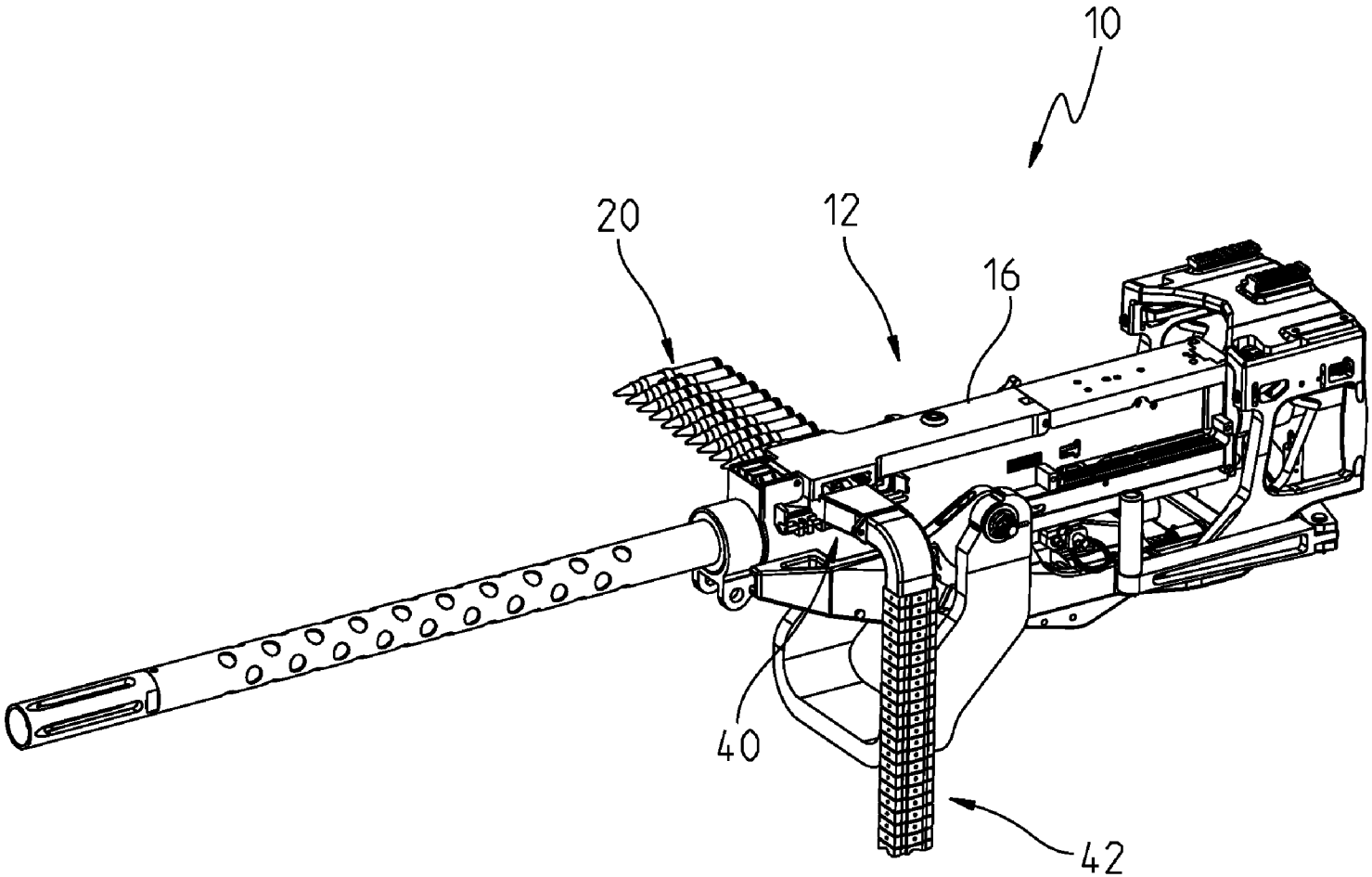
FIG. 1 is a perspective view of an illustrative machine gun for use with the link chute ejection adapter of the present disclosure.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplification set out herein illustrates embodiments of the invention, and such exemplifications are not to be construed as limiting the scope of the invention in any manner.

DETAILED DESCRIPTION OF THE DRAWINGS

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrated devices and described methods and further applications of the principles of the invention which would normally occur to one skilled in the art to which the invention relates.

Figure 2:
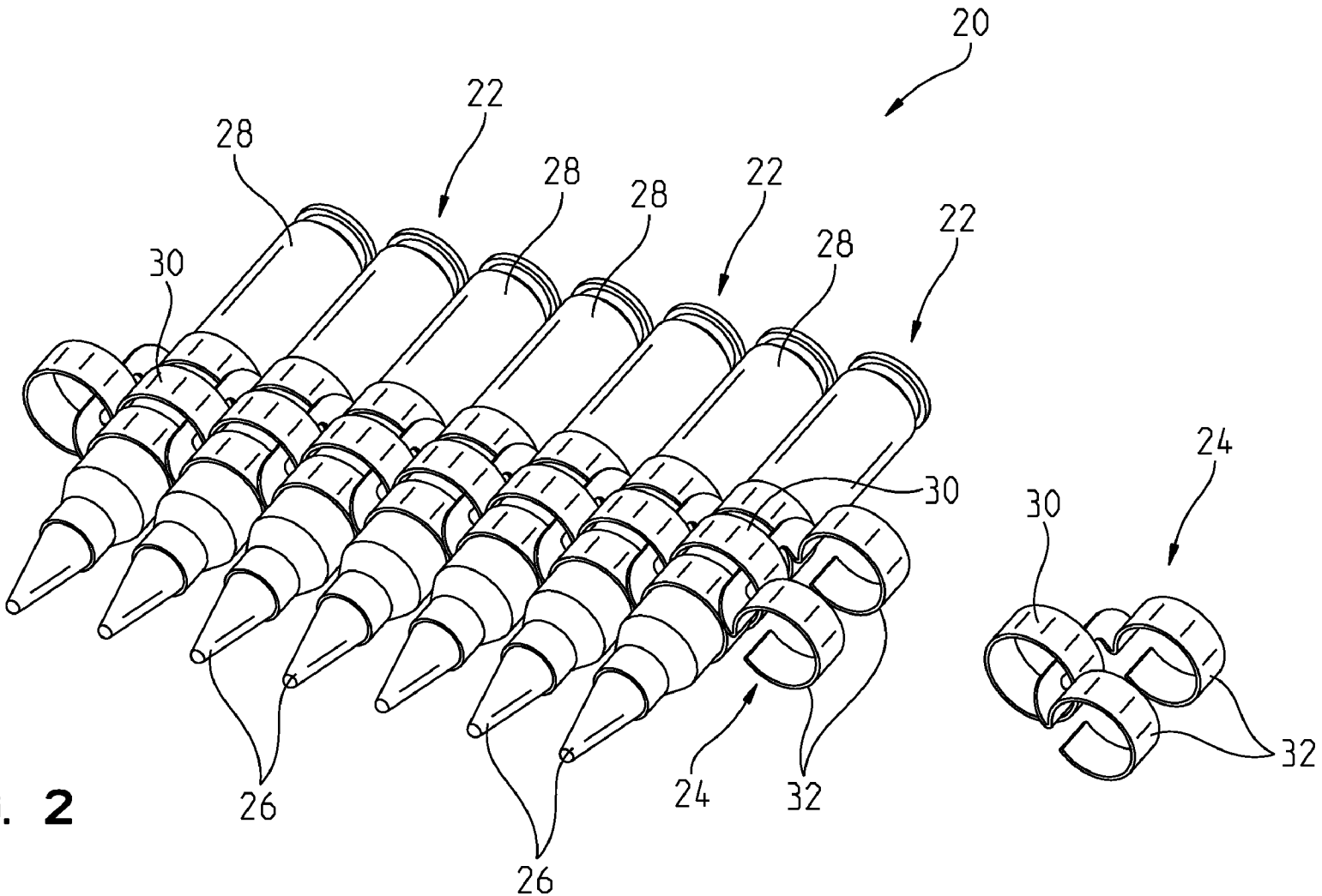
FIG. 2 is a partially exploded perspective view of an illustrative ammunition belt for use with the machine gun of FIG. 1.
Figure 3:
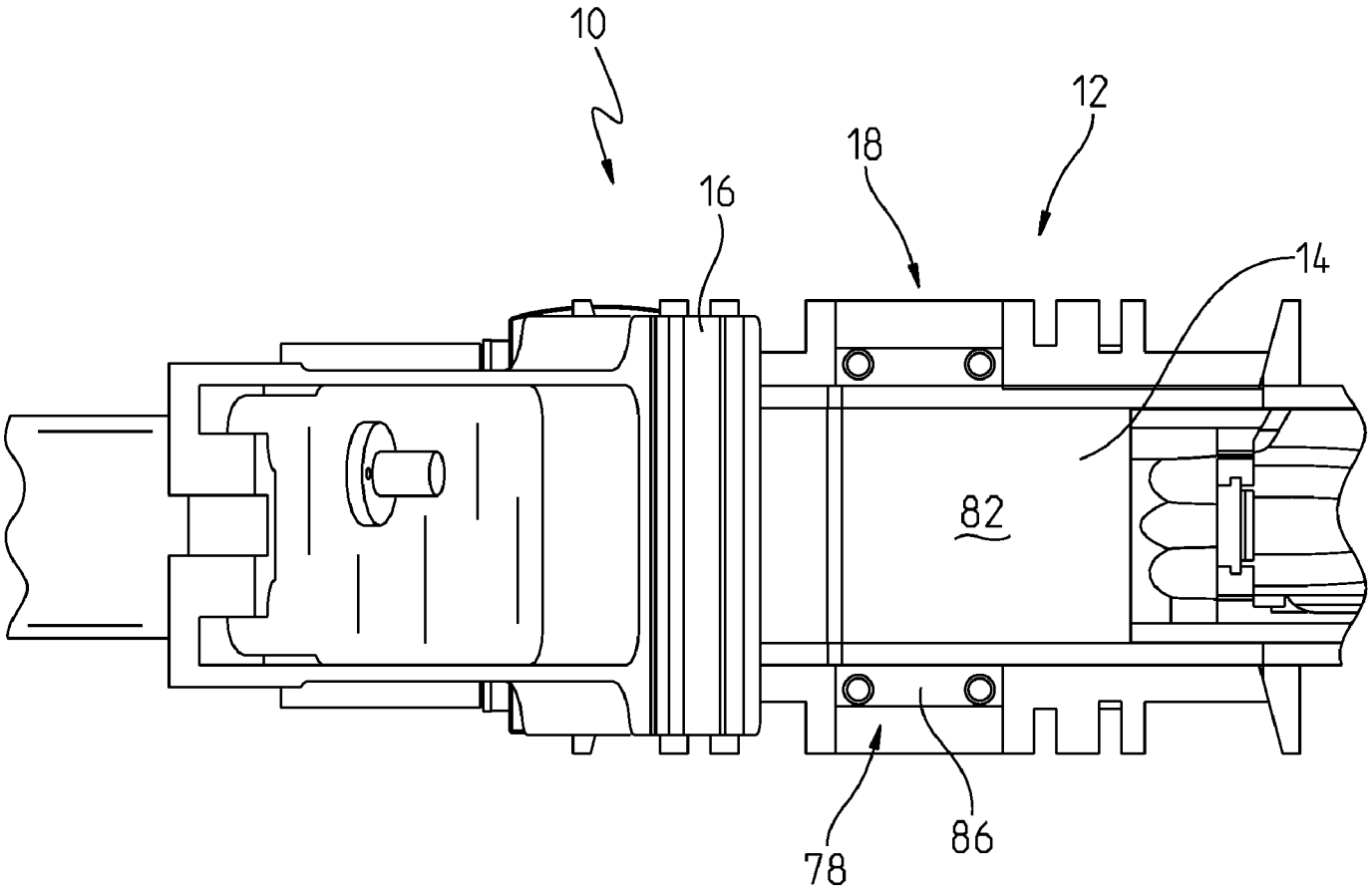
FIG. 3 is a top perspective view of an illustrative receiver of the machine gun of FIG. 1.
Figure 4A:
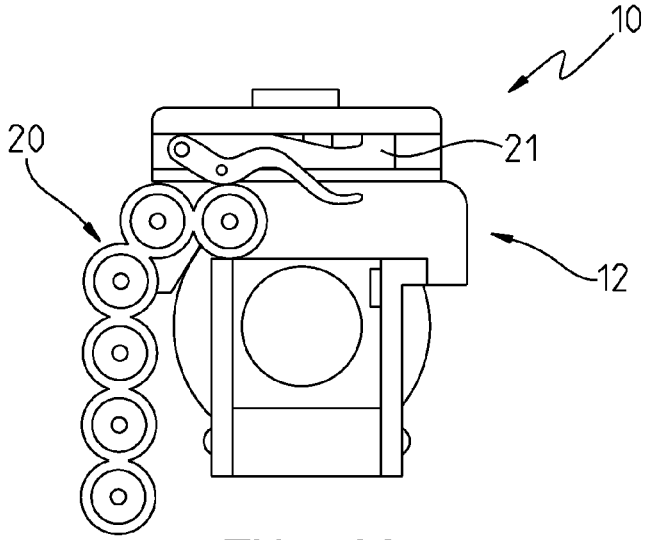
FIGS. 4A-4C are cross-sectional views, in partial schematic, of the receiver of FIG. 3 showing an ammunition belt being fed therethrough.
Figure 4B:
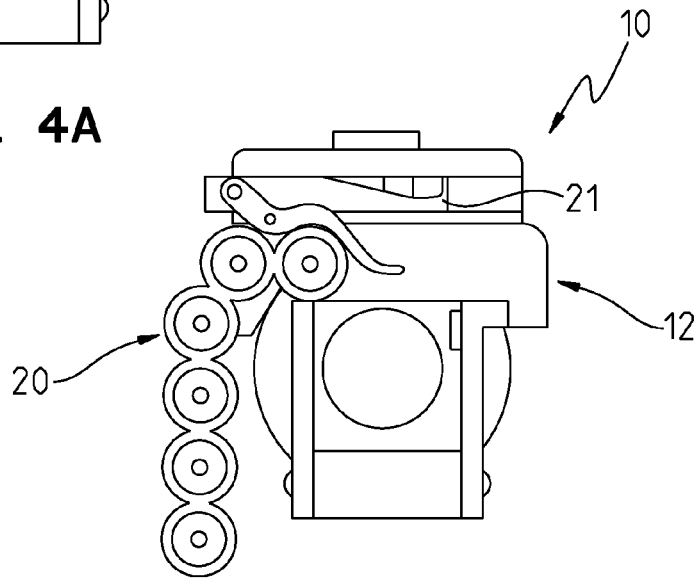
Figure 4C:
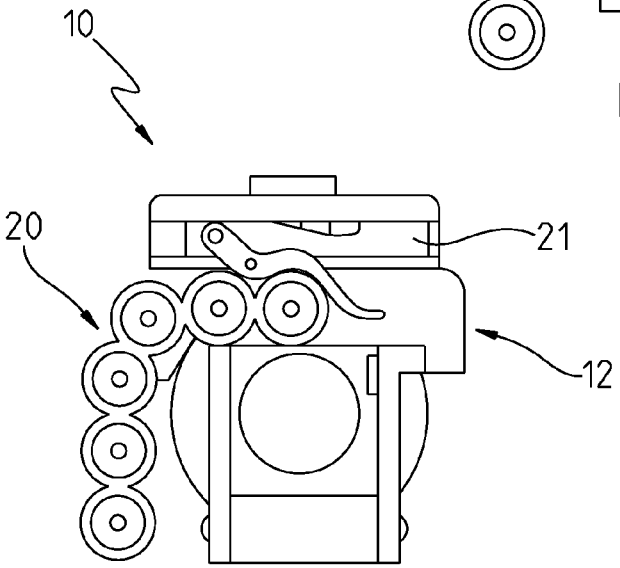

Referring initially to FIGS. 1-3, a weapon 10, illustratively a 50 caliber machine gun, includes a receiver 12 having a floor 14 and a hinged lid 16 defining a receiver chamber 18. As is known, an ammunition belt 20 is configured to be drawn or pulled by a feed slide assembly 21 into receiver chamber 18 across upper surface 82 of floor 14 (FIGS. 4A-4C). As shown in FIG. 2, ammunition belt 20 typically includes a plurality of rounds 22 interconnected by links 24. Each round 22 illustratively includes a bullet 26 received within a casing 28. Each casing 28 is coupled to an adjacent casing 28 via a link 24. Links 24 illustratively include a first arcuate engagement member 30 extending in a first direction and a pair of arcuate engagement members 32 extending in a second direction, opposite the first direction of first arcuate engagement member 30.

Figure 5A:
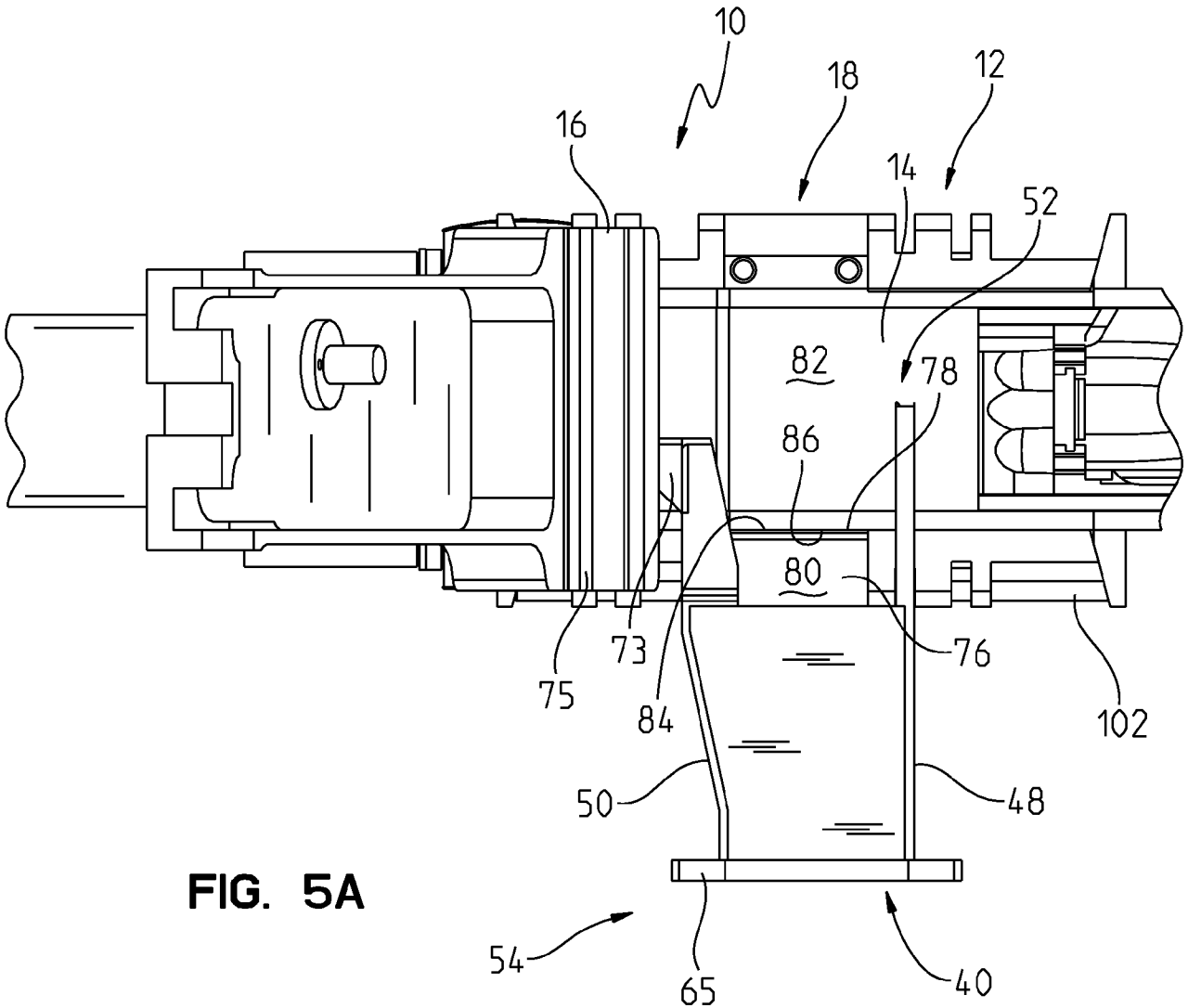
FIG. 5A is a top perspective view showing the link chute ejection adapter of the present disclosure coupled to the machine gun of FIG. 3, with the receiver lid in an open position.
Figure 5B:
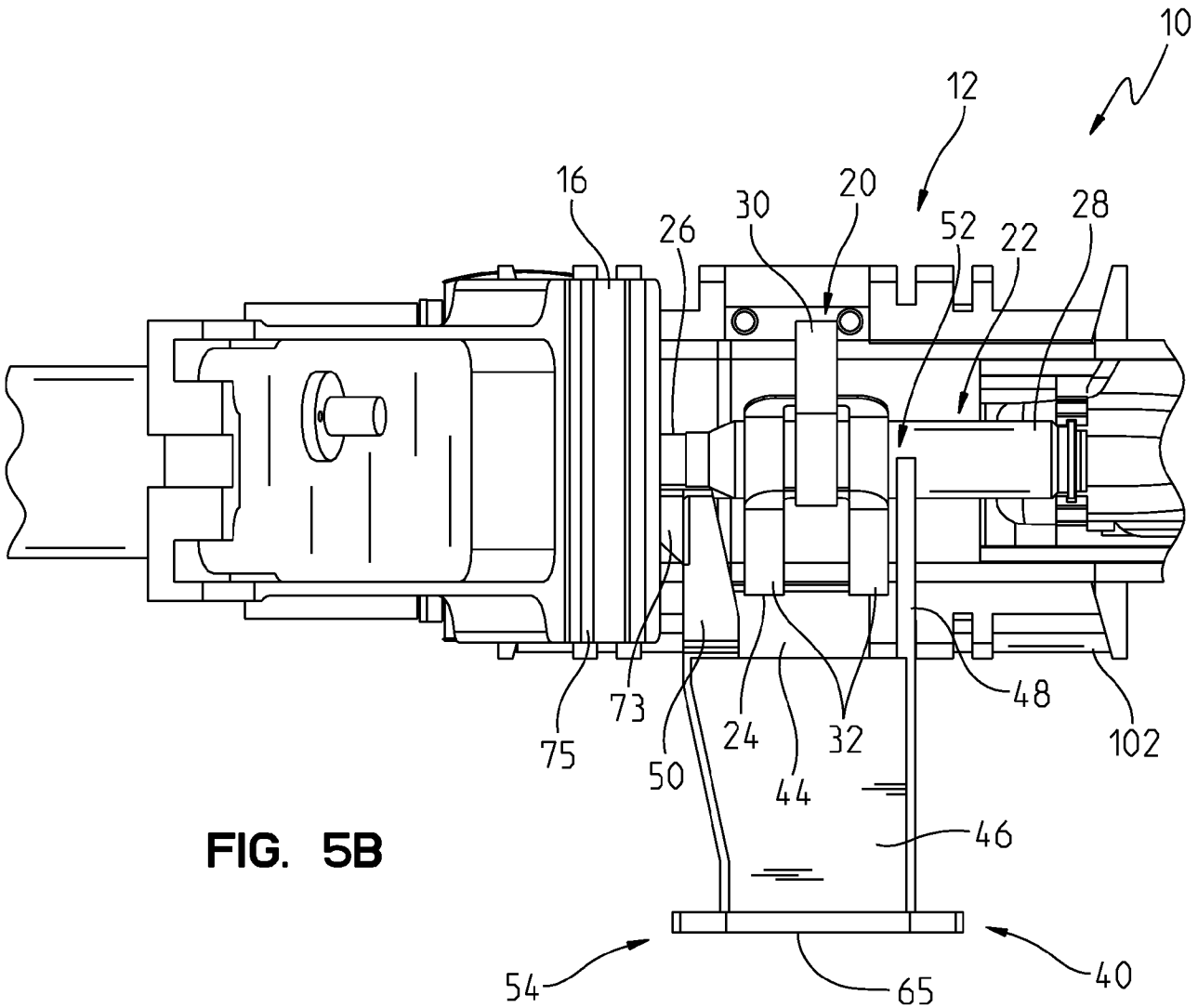
FIG. 5B is a perspective view similar to FIG. 5A, showing a round and link within the receiver.

Referring to FIG. 5B, round 22 is illustrated within receiver chamber 18. During operation of weapon 10, bullet 26 is expelled or discharged from casing 28 by a firing mechanism (not shown) of weapon 10. The spent casing 28 and link 24 are thereafter ejected from receiver chamber 18 of weapon 10. More particularly, casing 28 typically falls downwardly from weapon 10, while the spent link 24 is ejected outwardly from receiver chamber 18. More particularly, the spent link 24 is ejected laterally and outwardly from a side of receiver chamber 18 opposite the side of receiver chamber 18 in which ammunition belt 20 is pulled into receiver chamber 18 (FIG. 4A).

Figure 13:
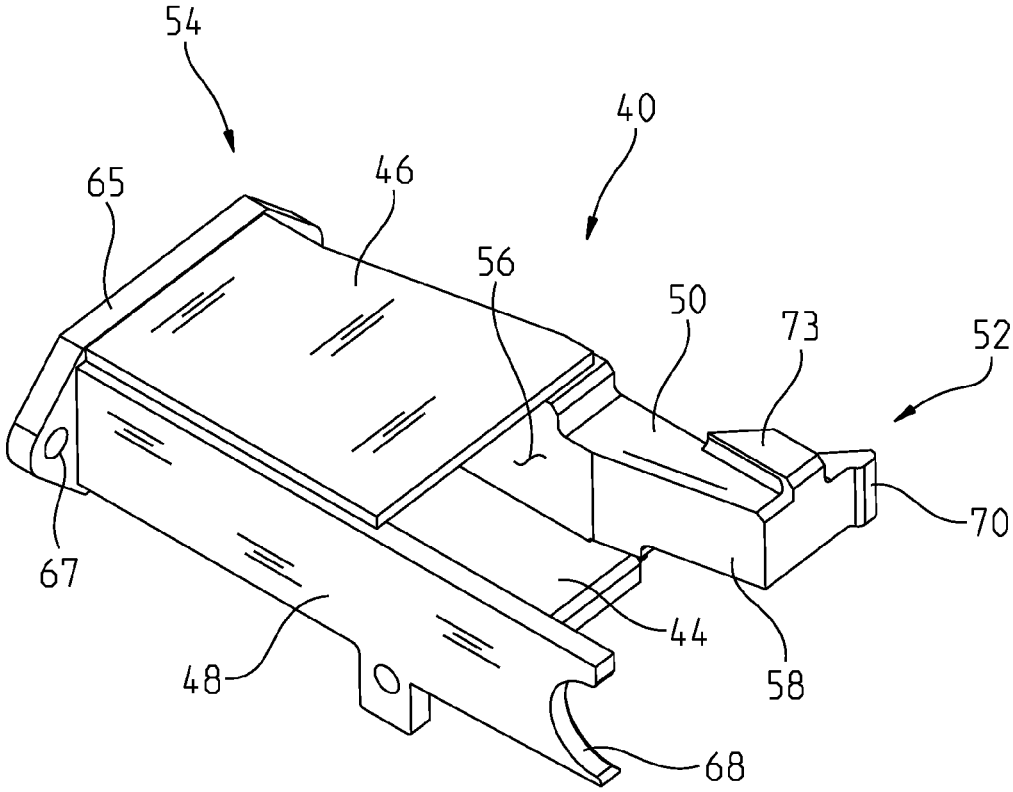
FIG. 13 is a rear perspective view of the link chute ejection adapter of FIG. 8.
Figure 14:
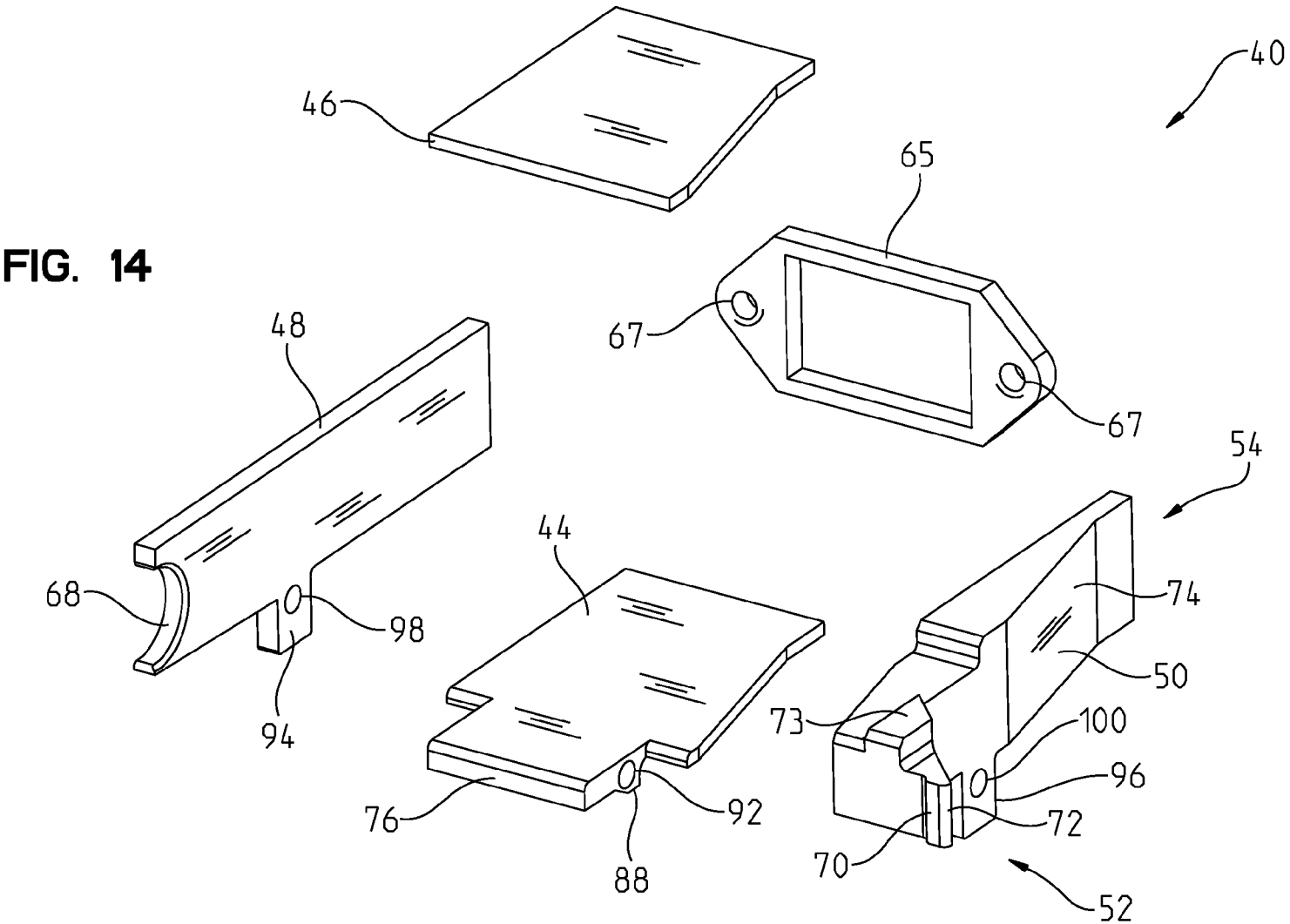
FIG. 14 is an exploded perspective view of the link chute ejection adapter of FIG. 8.

Referring to FIGS. 5A-14, link chute ejection adapter 40 of the present disclosure is configured to receive the spent links 24 of ammunition belt 20 (FIGS. 1 and 2) and facilitate conveyance of the spent links 24 to a link chute 42 (FIG. 14). Link chute ejection adapter 40 illustratively includes a lower member or base 44 positioned below an upper member or cover 46. First side member or wall 48 and second side member or wall 50 are coupled to base 44 and cover 46. First side member 48 and second side member 50 extend generally in an axial direction from proximal end 52 to distal end 54 in a laterally spaced relation.

With reference to FIGS. 8, and 10-14, second side wall 50 includes an inner surface 56 having an angled portion 58 extending inwardly toward first side wall 48 as it extends from proximal end 52 toward distal end 54. In operation, angled portion 58 assists in guiding the spent links 24 (FIG. 2) toward the link chute 42 (FIG. 15).

Figure 7:
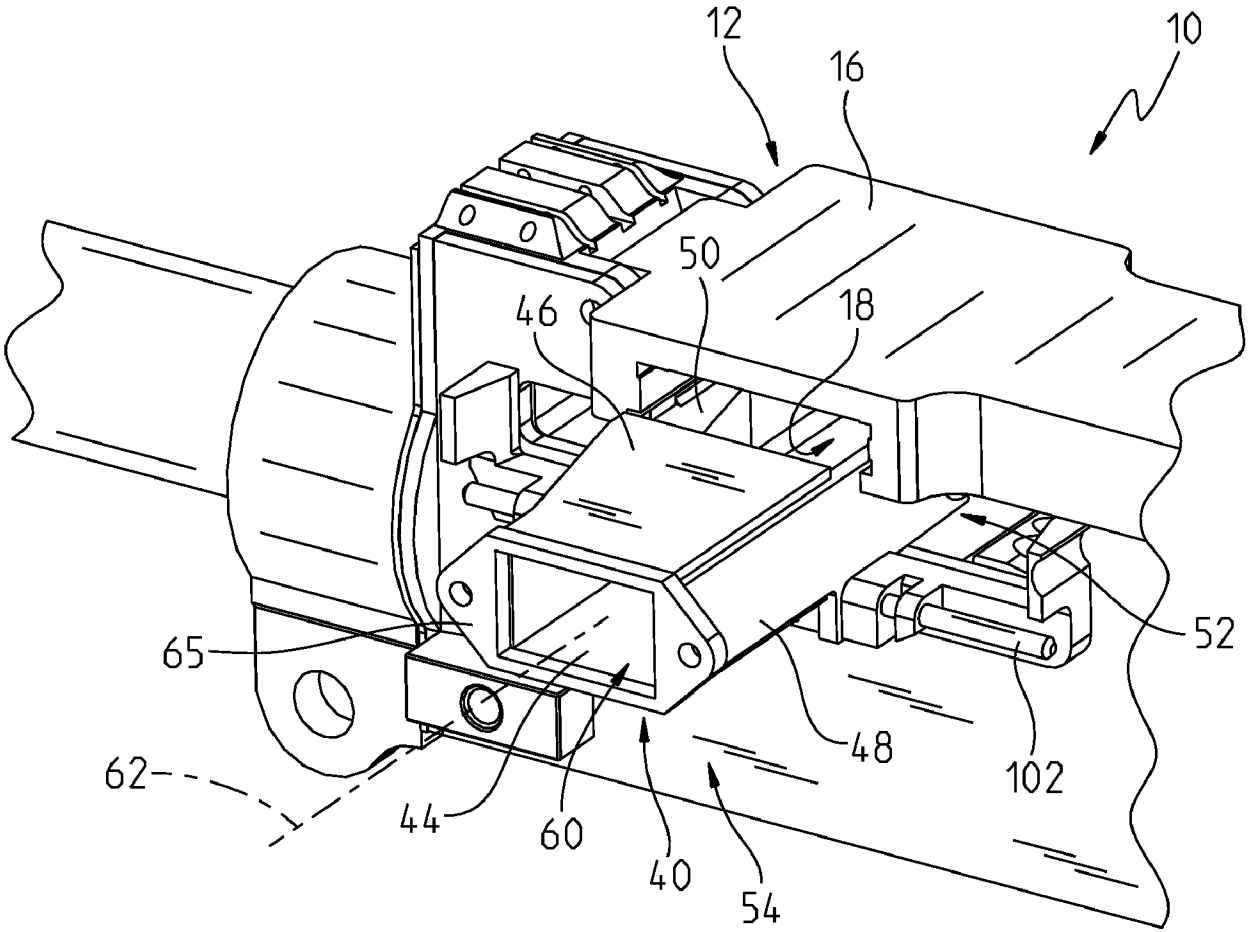
FIG. 7 is a side perspective view of the link chute ejection adapter of FIG. 6A coupled to the machine gun.
Figure 8:
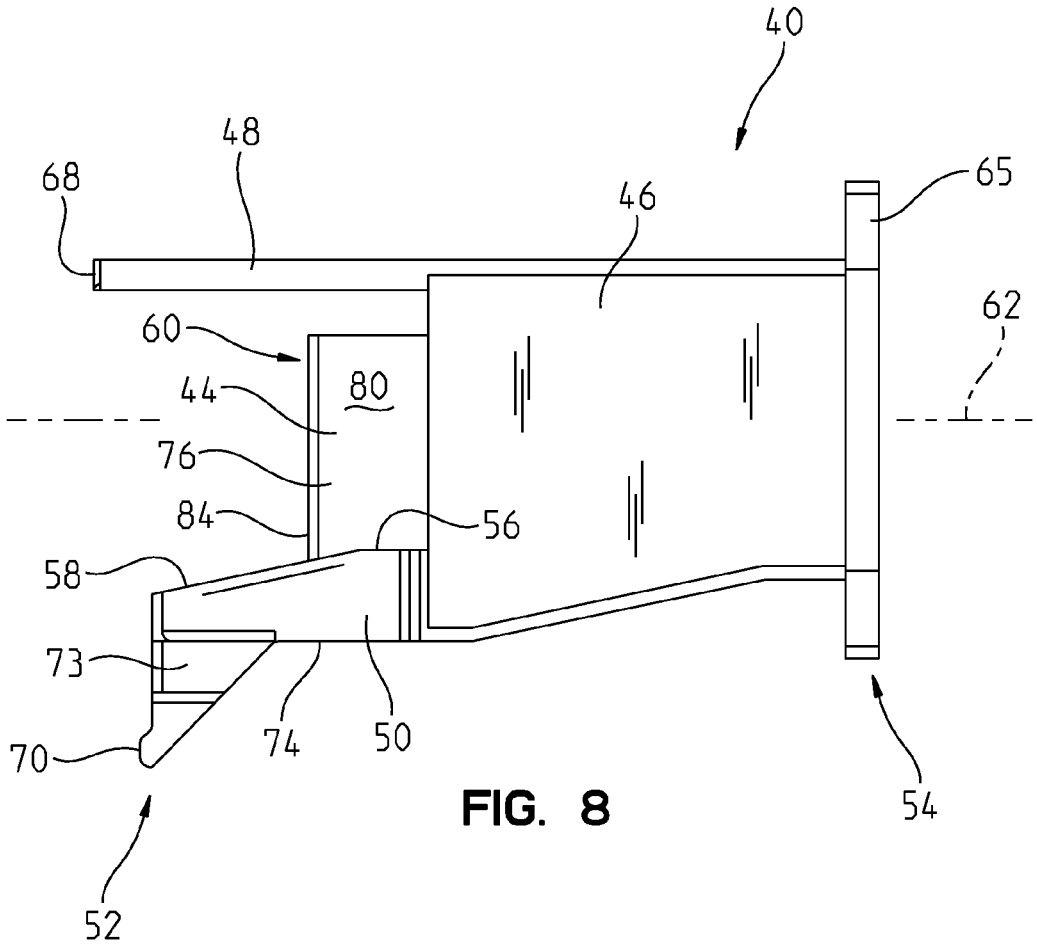
FIG. 8 is a further top perspective view of the link chute ejection adapter of FIGS. 6A and 6B.
Figure 9:
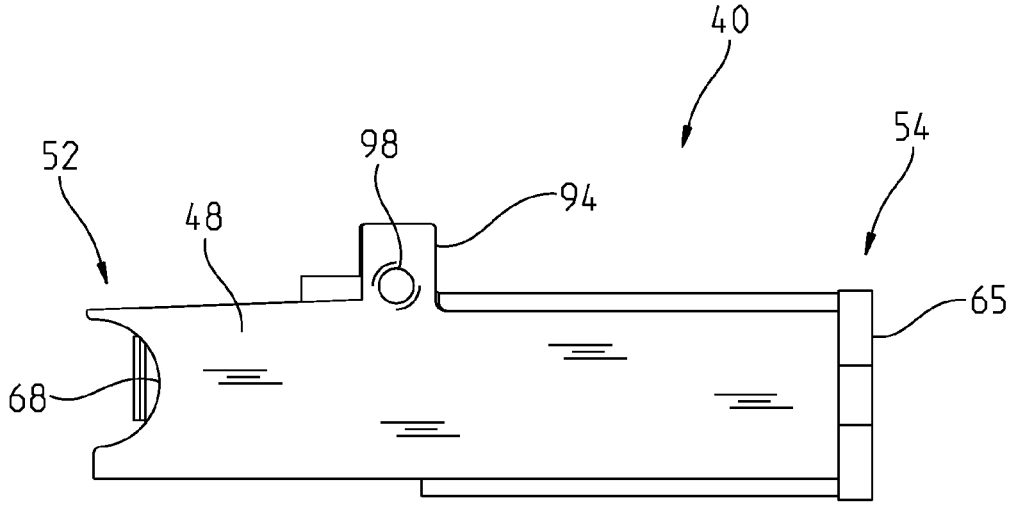
FIG. 9 is a first side view of the link chute ejection adapter of FIG. 8A.

Referring to FIGS. 7 and 8, base 44, cover 46, first side member 48, and second side member 50 define an ejection chamber 60 extending axially away from weapon 10 (laterally with respect to receiver chamber 18) along longitudinal axis 62. Proximal end 52 of link chute adapter 40 is configured to be operably coupled to receiver 12 of weapon 10, and distal end 54 is configured to be operably coupled to link chute 42 (FIG. 14).

Figure 15:
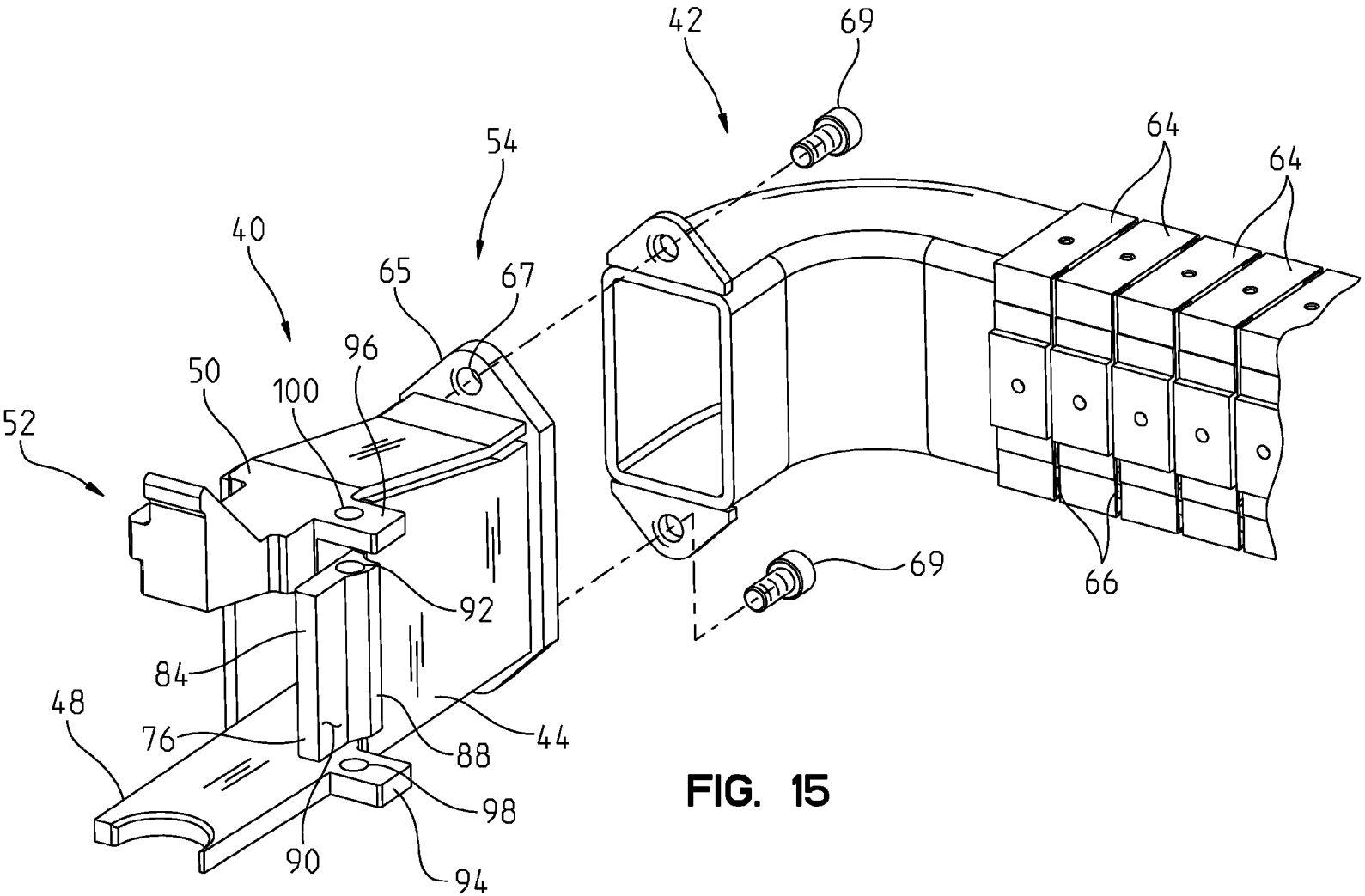
FIG. 15 is a perspective view showing a link chute configured to be coupled to the link chute ejection adapter of FIG. 8.

With reference to FIG. 15, link chute 42 illustratively includes a plurality of stainless steel guide members 64 pivotally coupled together by connectors 66 for providing flexibility therebetween. Link chute 42 may be of conventional design and is illustratively manufactured by Standard Armament of Glendale, Calif.

Figure 10:
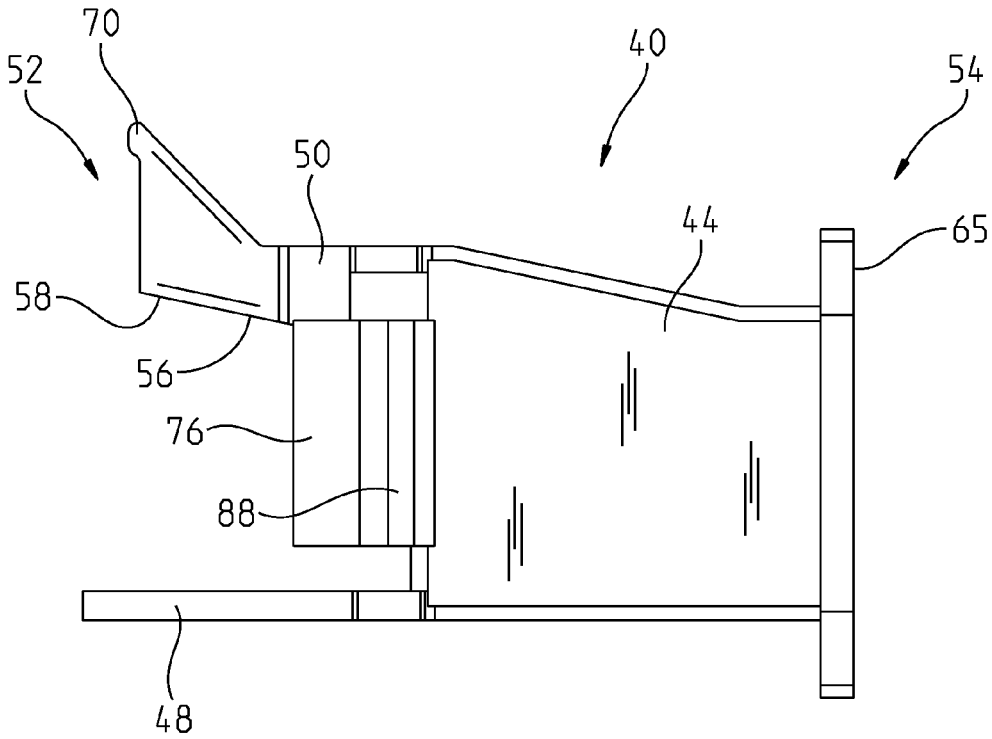
FIG. 10 is a bottom perspective view of the link chute ejection adapter of FIG. 8.
Figure 11:
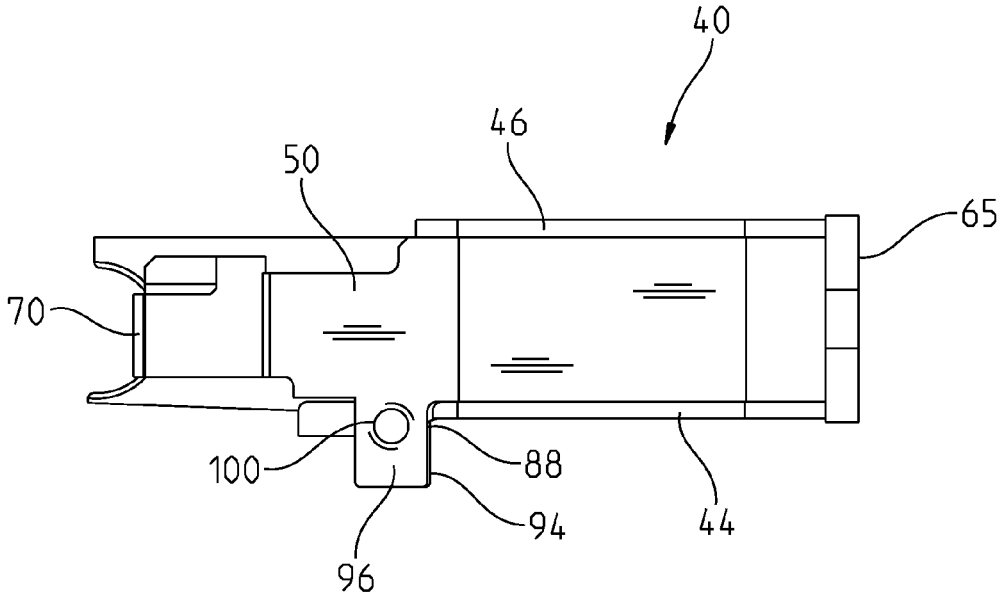
FIG. 11 is a second side view of the link chute ejection adapter of FIG. 8.
Figure 12:
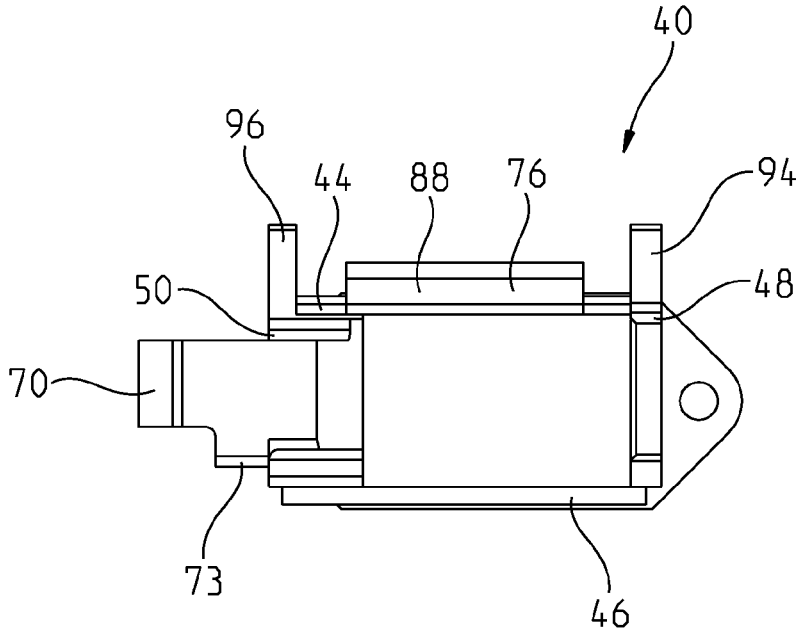
FIG. 12 is an end view of the link chute ejection adapter of FIG. 8.

With reference to FIGS. 10, 13 and 14; first side member 48 and second side member 50 are illustrated as being rigidly fixed, illustratively through welding, to base 44 and cover 46. Each of base 44, cover 46, first side member 48, and second side member 50 are illustratively formed of a rigid material, such as steel. As such, link chute ejection adapter 40 forms a substantially rigid structure.

Referring to FIGS. 7 and 14, link chute coupler 65 is illustratively fixed to distal end 54 of link chute ejection adapter 40. More particularly, link chute coupler 65 is illustratively formed of metal, such as steel, and is welded to base 44, cover 46, first side member 48, and second side member 50. Link chute coupler 65 may include apertures 67 for threadably receiving screws 69 to secure link chute 42 to link chute ejection adapter 40.

With further reference to FIGS. 5B, 13, and 14, an arcuate casing stop 68 is supported by proximal end 52 of first side member 48 for locating casing 28 of an ammunition belt 20 (FIG. 2) within receiver chamber 18. A bullet stop 70 is supported by proximal end 52 of second side member 50 for locating bullet 26 of an ammunition belt 20 (FIG. 2) within receiver chamber 18. Bullet stop 70 illustratively includes a finger 72 extending axially outwardly away from the ejection chamber 60 and transversely outwardly away from an outer surface 74 of second side member 50. Protrusion 73 extends upwardly at proximal end 52 of second side member 50 and is configured to be engaged by a lower surface 75 of hinged lid 16 when in a lowered position to assist in securing proximal end 52 of link chute ejection adapter 40 within receiver chamber 18.

With reference to FIGS. 5A, 8, 14, and 15, base 44 includes a tongue 76 supported at proximal end 52 for mating with floor 14 of receiver chamber 18 of weapon 10. More particularly, tongue 76 illustratively is received within a recess 78 defined by floor 14 of receiver chamber 18. Tongue 76 includes an upper surface 80 configured to be parallel or flush with upper surface 82 of floor 14. Further, the tongue 76 includes an outer edge 84 configured to be in close proximity to, and illustratively about, edge 86 of recess 78 of floor 14. As such, tongue 76 reduces potential gaps between floor 14 of receiver 12 and upper surface 80 of tongue 76, while also reducing elevational differences therebetween. Tongue 76 reduces the likelihood of a spent link 24 being caught or jammed at the interface of receiver 12 and link chute ejection adapter 40.

With reference to FIGS. 14 and 15, a mounting boss 88 extends downwardly from lower surface 90 tongue 76 and includes a transversely extending mounting aperture 92. First and second mounting tabs 94 and 96 extend downwardly from first side member 48 and second side member 50, respectively. Each of the first and second mounting tabs 94 and 96 include an aperture 98 and 100 axially aligned with mounting aperture 92 of mounting boss 88 of base 44. A pin 102 (FIG. 5A) is configured to extend through mounting apertures 92, 94, 98 and 100 of base 44, first side member 48, second side member 50 for securing link chute ejection adapter 40 to receiver 12 of weapon 10.

Figure 6A:
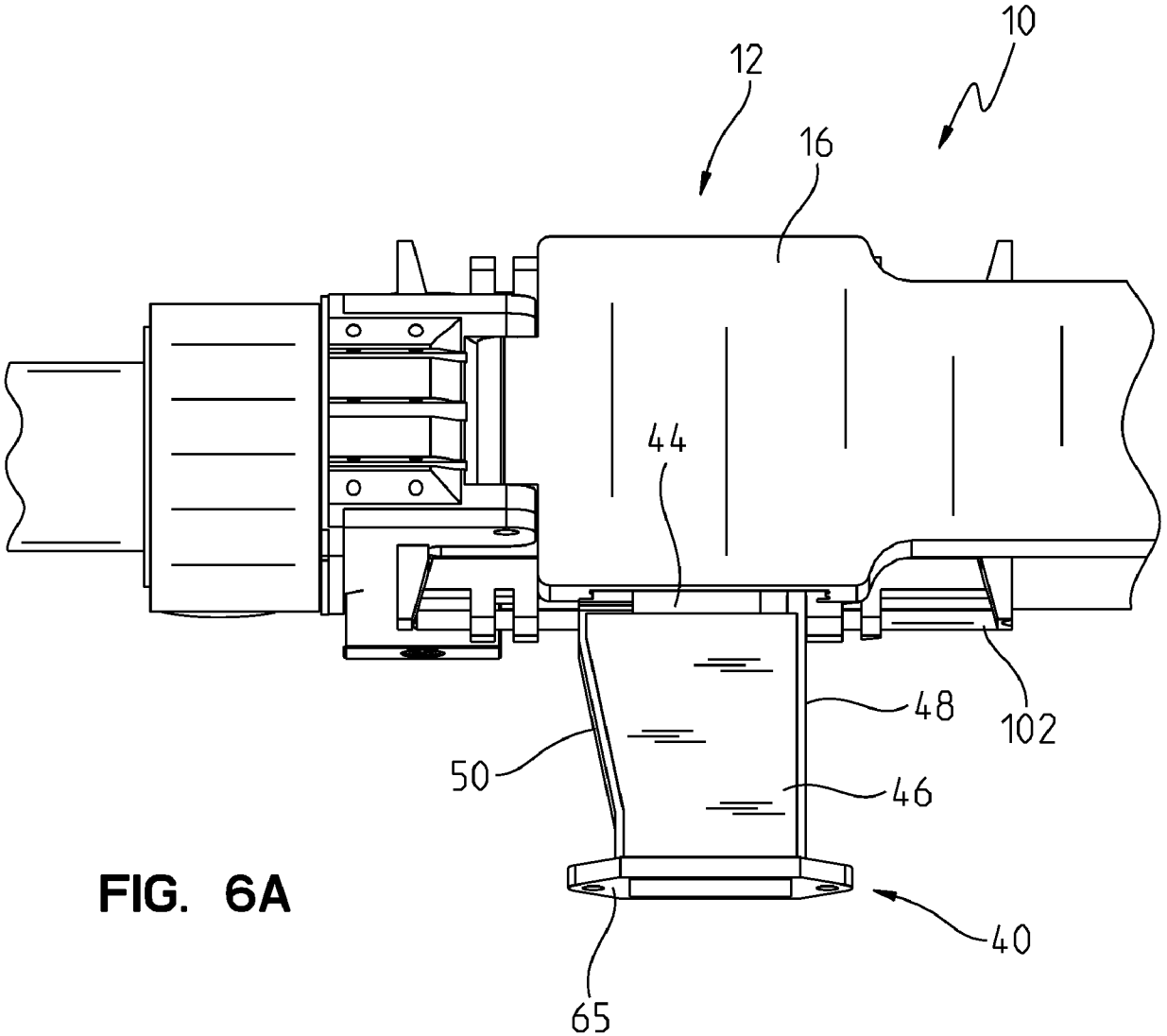
FIG. 6A is a perspective view similar to FIG. 5A, showing the receiver lid in a closed position.
Figure 6B:
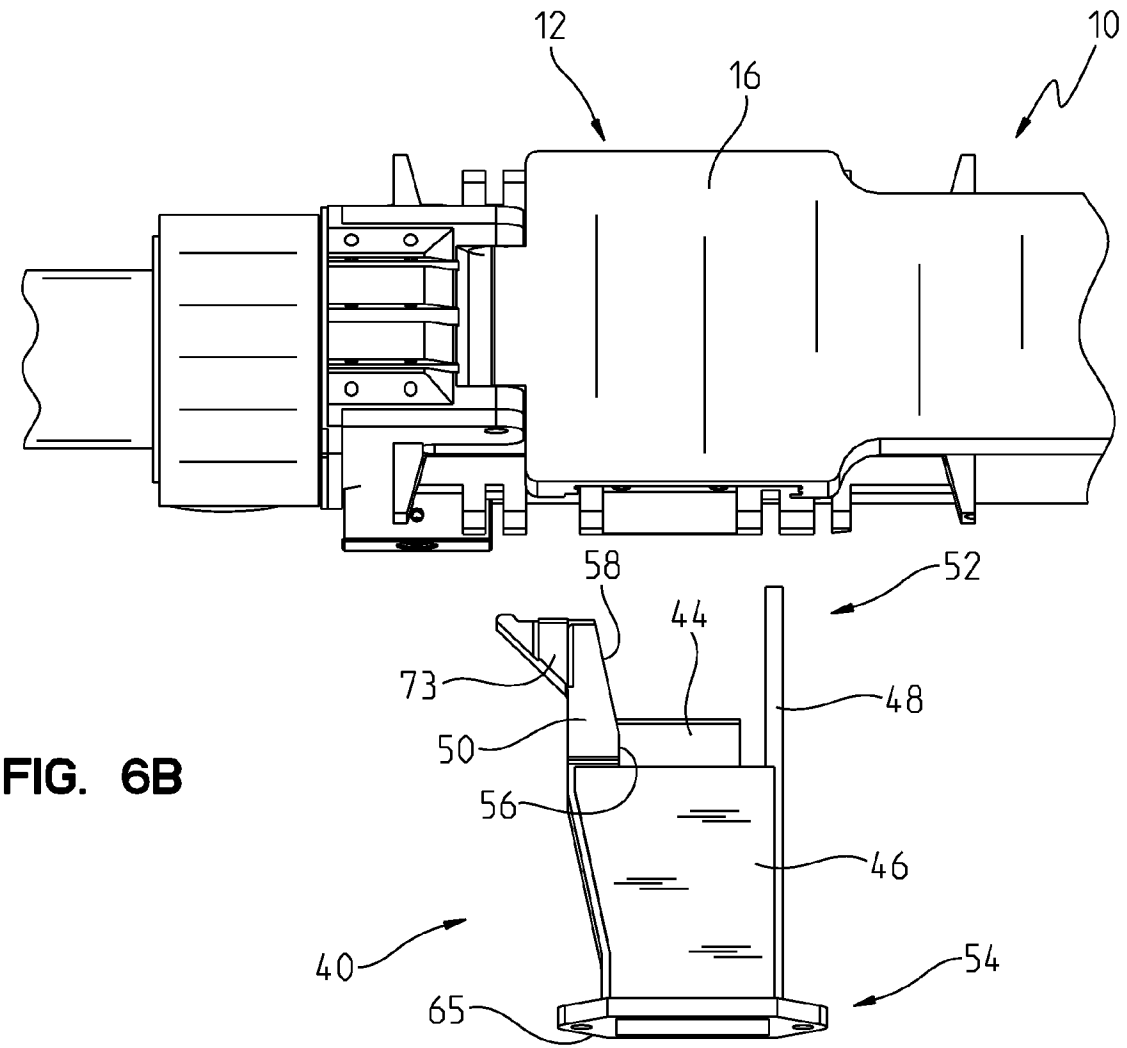
FIG. 6B is a top perspective view of a link chute ejection adapter of FIG. 6A, showing the adapter uncoupled from the machine gun.

As illustrated in FIGS. 6A and 7, cover 46 is configured to reduce gaps between receiver 12 and link chute ejection adapter 40 and thereby reduce the likelihood of catching or jamming spent links 24 (FIG. 5B) therebetween. Illustratively, cover 46 is positioned no more than about 0.050 inches from feed slide assembly 21 of weapon 10 when feed slide assembly 21 is positioned in its closest proximity to cover 46.

Figure 16B:
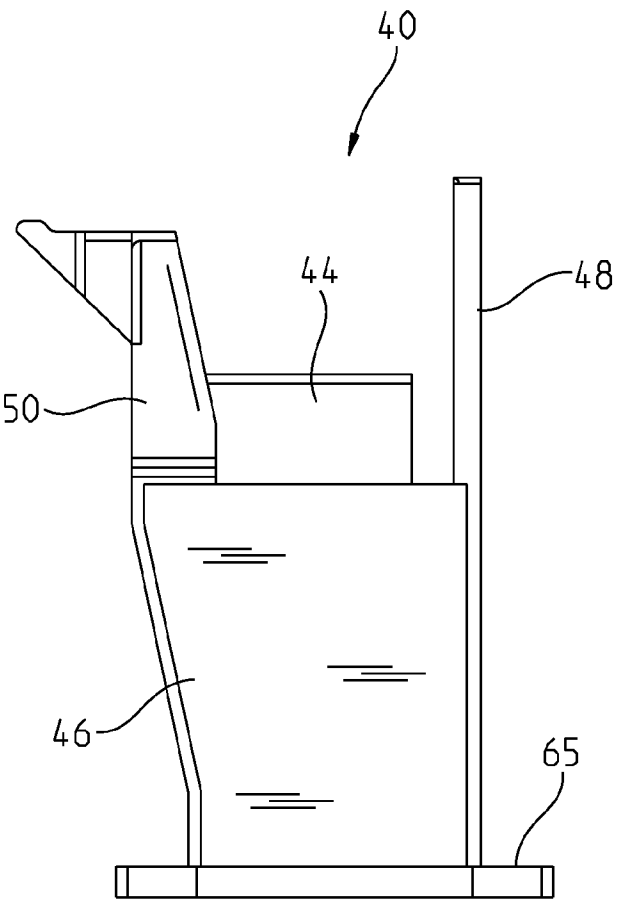
FIG. 16B is a top perspective view similar to FIG. 16A showing a right link chute ejection adapter, the right link chute ejection adapter being a mirror image of the left link chute ejection adapter.
Figure 16A:
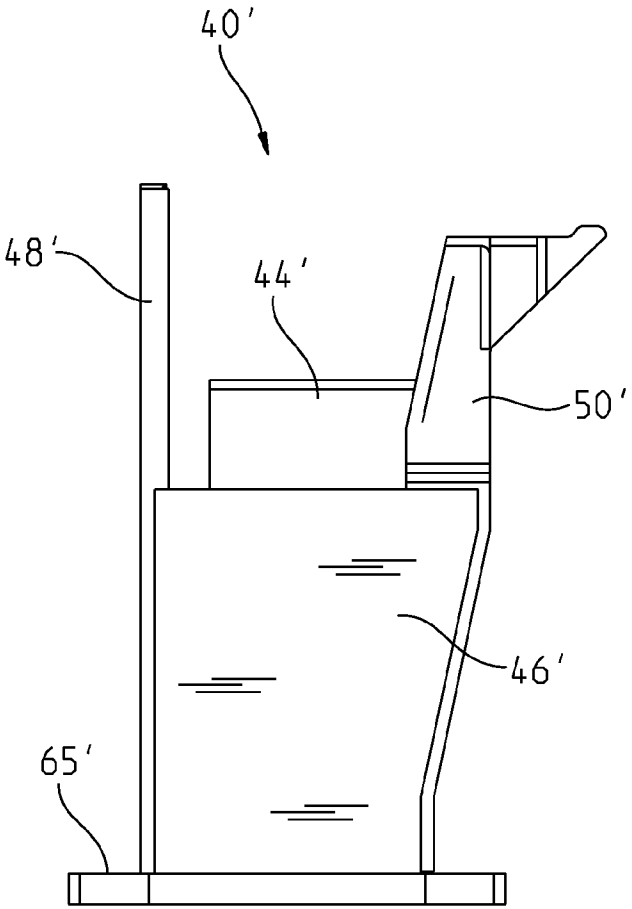
FIG. 16A is a top perspective view showing the left link chute ejection adapter of FIG. 8.

With reference to FIGS. 16A and 16B, link chute ejection adapter 40 is configured to be removably coupled to the left side of weapon 10. However, link chute ejection adapter 40' is essentially a mirror image of link chute ejection adapter 40 and configured to be removably coupled to the right side of weapon 10.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A link chute ejection adapter for a weapon discharging rounds from an ammunition belt, the link chute ejection adapter comprising:

a base having an upper surface, a lower surface, a proximal end, and a distal end;

a cover positioned above the base;

a first side wall rigidly coupled to the base and the cover, the first side wall including a proximal end configured to be removably received within a receiver chamber of the weapon;

a second side wall positioned in spaced relation to the first side wall and rigidly coupled to the base and the cover, the second side wall including a proximal end configured to be removably received within the receiver chamber of the weapon;

an ejection chamber defined by the base, the cover, the first side wall, and the second side wall, the ejection chamber extending in an axial direction generally along a longitudinal axis from a proximal end to a distal end, the proximal end coupled to the receiver chamber of the weapon and the distal end configured to be coupled to an ejection chute;

a casing stop supported by the proximal end of the first side wall for locating a casing of the ammunition belt; and a bullet stop supported by the proximal end of the second side wall for locating a bullet of the ammunition belt, the bullet stop including a finger extending axially outwardly away from the ejection chamber and transversely outwardly away from an outer surface of the second side wall.

2. The link chute ejection adapter of claim 1, wherein the second side wall further includes an inner surface angled relative to the first side wall to guide spent links of the ammunition belt from the receiver chamber in a direction from the proximal end toward the distal end of the ejection chamber.

3. The link chute ejection adapter of claim 1, wherein the proximal end of the second side wall further comprises an upwardly extending protrusion configured to be engaged by the receiver lid of the weapon.

4. The link chute ejection adapter of claim 1, wherein the bullet stop is integral with the second side wall.

5. The link chute ejection adapter of claim 1, further comprising a chute coupler supported at the distal ends of the first and second side walls and configured to couple with an ejection chute.

6. The link chute ejection adapter of claim 1, further comprising a mounting boss extending downwardly from the base and including an opening for receiving a pin for securing to the weapon.

7. The link chute ejection adapter of claim 6, further comprising a first mounting tab extending downwardly from the first side wall and including an opening, and a second mounting tab extending downwardly from the second side wall and including an opening, the openings of the first and second mounting tabs aligned with the opening of the mounting boss for receiving the pin.

8. The link chute ejection adapter of claim 1, wherein the proximal end of the upper surface of the base defines a tongue that is received within the receiver chamber of the weapon and is substantially flush with a floor of the receiver chamber of the weapon.

9. The link chute ejection adapter of claim 1, wherein the cover is spaced no more than 0.050 inches from a feed slide assembly of the weapon.

10. A link chute ejection adapter for a weapon configured to discharge rounds of ammunition from an ammunition belt in which the rounds of ammunition are connected by links, the link chute ejection adapter comprising:

a base including a proximal end and a distal end, the base further including a tongue supported at the proximal end for mating with a floor of a receiver chamber of the weapon, and a mounting boss extending downwardly from the tongue and having an opening configured to receive a pin for securing the link chute ejection adapter to the weapon;

a cover positioned above the base;

a first side wall coupled to the base and the cover, the first side wall including a proximal end configured to be removably received within a receiver chamber of the weapon;

a second side wall positioned in spaced relation to the first side wall and coupled to the base and the cover, the second side wall including a proximal end configured to be removably received within the receiver chamber of the weapon;

a link chute coupler supported at the distal end of the base and configured to couple a link chute to the link chute ejection adapter;

a casing stop supported by the proximal end of the first side wall for locating a casing of the round; and a bullet stop supported by the proximal end of the second side wall for locating a bullet of the round, the bullet stop including a finger extending axially outwardly away from the receiver chamber of the weapon and transversely outwardly away from an outer surface of the second side wall.

11. The link chute ejection adapter of claim 10, wherein the bullet stop is integral with the second side wall.

12. A weapon system comprising:

an ammunition belt including a plurality of rounds interconnected by a plurality of links, wherein each of the plurality of rounds includes a bullet and a casing;

a weapon including a receiver for receiving a round of the ammunition belt, the receiver having a receiver floor, a movable lid, and a feed slide assembly for pulling the ammunition belt across the receiver floor;

a link chute ejection adapter including a base, a cover, a first side wall having a proximal end and a distal end, a second side wall having a proximal end and a distal end, and a chute coupler supported proximate the distal end of the first side wall and the second side wall;

wherein the base includes a mounting boss for coupling the link chute ejection adapter to the weapon, and a tongue having an upper surface and abutting a side edge of the receiver floor such that the upper surface is substantially flush with the receiver floor;

a link chute coupled to the chute coupler of the link chute ejection adapter;

a casing stop supported by the proximal end of the first side wall for locating a casing of the round; and a bullet stop supported by the proximal end of the second side wall for locating a bullet of the round.

13. The weapon system of claim 12, wherein the bullet stop includes a finger extending axially outwardly and transversely outwardly away from the second side wall.

14. A method of ejecting spent links from a weapon system, the method including the steps of:

aligning a link ejection chute adapter to a receiver of a weapon such that a tongue at the proximal end of the link chute ejection adapter is substantially flush with a receiving floor of the receiver;

coupling the link chute ejection adapter to the receiver;

coupling a link chute to a distal end of the link ejection chute adapter;

drawing an ammunition belt into a receiver chamber of the weapon, the ammunition belt including rounds of ammunition connected by links, each of the rounds including a bullet and a casing;

locating a casing of the ammunition when the round is drawn into the receiver chamber of the weapon by a casing stop member supported at a proximal end of a first side wall of the link ejection chute adapter;

locating a bullet of the ammunition when the round is drawn into the receiver chamber of the weapon by a bullet stop member supported at the proximal end of a second side wall of the link ejection chute adapter;

expelling the bullet from the casing, wherein the bullet is expelled from the casing by activation of a firing mechanism of the weapon;

ejecting the casing from the receiver chamber, wherein the casing is ejected downwardly from the weapon following the expelling of the bullet from the casing;

ejecting the link from the receiver chamber, wherein the link is ejected laterally from the receiver chamber; and guiding the link into the link ejection chute adapter.

15. The method of claim 14, further comprising the step of guiding the link from the receiver chamber into the link ejection chute adapter by the second side wall which includes an inner surface angled relative to the first side wall.

16. The method of claim 14, wherein the step of coupling the link chute ejection adapter to the receiver comprises passing a pin through a mounting boss extending downwardly from the tongue.

17. The method of claim 16, wherein a protrusion extends upwardly from the link chute ejection adapter and is configured to be engaged by a movable lid of the weapon.

* * * * *